US006328492B1

(12) United States Patent
McKay et al.

(10) Patent No.: US 6,328,492 B1
(45) Date of Patent: Dec. 11, 2001

(54) PRINTER HAVING A REMOVABLE PAPER TRAY WITH INTEGRATED PLATEN AND CAPPING STATIONS

(75) Inventors: Kerry N. McKay, San Diego; Daniel S. Kilne, Encinitas, both of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/453,151

(22) Filed: Dec. 2, 1999

(51) Int. Cl.[7] ..... B41J 2/165

(52) U.S. Cl. ..... 400/656; 400/691; 347/29; 347/32; 347/33

(58) Field of Search ..... 400/88, 691, 693, 400/656, 649; 347/29, 32, 33, 34, 35, 36, 22, 101, 104

(56) References Cited

U.S. PATENT DOCUMENTS

| | | | | |
|---|---|---|---|---|
| 3,713,168 | * | 1/1973 | Baker | 346/74 E |
| 4,981,377 | * | 1/1991 | Hasegawa et al. | 400/608.2 |
| 5,364,196 | * | 11/1994 | Baitz et al. | 400/691 |
| 5,742,303 | * | 4/1998 | Taylor et al. | 347/36 |
| 5,757,398 | * | 5/1998 | Anderson | 347/32 |
| 6,168,258 | * | 1/2001 | Lou et al. | 347/33 |
| 6,172,691 | * | 1/2001 | Belon et al. | 347/32 |

* cited by examiner

*Primary Examiner*—John S. Hilten
*Assistant Examiner*—Kevin D. Williams

(57) ABSTRACT

The present invention is a low-height, narrow-width printer. The printer includes a removable input tray for storing input media and at least two printheads to print on the input media. The removable input tray includes an integrated platen and at least two capping stations preferably located at the center of the platen. The removable input tray also contains a motor to move the integrated capping stations up to cap the printheads during periods of non-use and down during use.

18 Claims, 4 Drawing Sheets

PRINTER HAVING A REMOVABLE PAPER TRAY WITH INTEGRATED PLATEN AND CAPPING STATIONS

BACKGROUND OF THE INVENTION

1. Field of the Invention

The invention relates generally to printers, and more particularly, to an inkjet printer having a removable paper tray with integrated platen and capping stations.

2. Related Art

Digital set-top boxes (e.g., cable television boxes, Internet terminal boxes etc.) are being used increasingly with consumer home entertainment equipment such as television sets, video cassette recorders, digital video disc (DVD) players and the like. In many cases, it is desirable for a user to obtain a hard copy of information displayed on the screen of their television sets. Specifically, users typically want to print e-mail messages, maps, recipes and information-rich content, such as still or captured scenes from live broadcasts, DVD players, movie cameras, video recorders etc.

Currently, if a user wants to have a hardcopy of the displayed information, the user has to use a conventional printer. Most conventional printers, however, are bulky, and thus require large amounts of space in user' home entertainment units. Hence, a printer specifically designed for use in home entertainment units is needed (i.e., a living room printer).

The living room printer should be of low height (i.e., low profile) and relatively narrow in width to blend in with other home entertainment equipment. In addition, since home entertainment equipment is usually stacked one atop another in home entertainment units, user access to the living room printer should preferably be through a front plane of the printer.

Designing a low profile, narrow width printer with user front plane access presents some technical difficulties. For example, conventional inkjet print engines contain three primary components, which are generally organized in series. Some of these components include the platen and service station. The platen has a printing area where print media (i.e., paper) are printed upon. The service station includes a spittoon receptacle in which print drops are disposed to clear the nozzles. The service station also contains a wiper to wipe clean the printhead during use and a cap to prevent the printhead from drying out during periods of non-use.

Further, many conventional inkjet print engines contain two or more printheads mounted side by side on a transversing carriage. Consequently, two or more service stations, including each a wiper and cap, are used. The caps are spaced at a center to center distance of the printheads so that each printhead can be simultaneously capped during periods of inactivity. The wipers are mounted to allow the printheads to be wiped clean during use. Ordinarily, only one spittoon is used. However, sometimes because of ink incompatibility more than one spittoon is used. Thus, the total width of conventional printers typically depends on the width of the service stations, the platen (which is at least the width of the print media), the width of one or more spittoons and the excursion of the printhead carriage.

Obviously therefore, if the capping stations can be located at the center of the platen rather than at either of its sides, the width of the printer can accordingly be reduced. But due to the requirement that user access be from the front plane of the printer, if the capping stations are placed at the center of the platen, the input tray will have to slide in and out of the printer underneath the capping stations. Having the input tray slide underneath the capping stations will result in a printer of a greater height; thus, violating the low profile requirement of the living room printer.

Consequently, what is needed is a printer that has a front access removable input paper tray with integrated platen and capping stations to keep the printer's height and width to a minimum.

SUMMARY OF THE INVENTION

To overcome the limitations of the systems and methods described above, and to overcome other limitations that will become apparent upon reading and understanding the present specification, the present invention is embodied in a low-profile and narrow-width printer having a removable paper tray to hold print media, a print engine mechanism to move the print media to a print zone and at least one printhead.

Preferably, multiple printheads are used, namely, one dispensing black ink and the other dispensing multi-color ink. The black ink printhead is used to print in black and white and the multi-color ink printhead is used to print in color. The printer also contains multiple service stations each one servicing a respective printhead. The removable tray contains an integrated platen. Two capping stations are placed at the center of the platen for capping the printheads during periods of non-use. Since the platen is incorporated with the removable tray, a low-profile printer is achieved. Further, integrating the capping stations in the platen allows for a narrow printer. The two service stations are preferably located each at one side of the platen. This configuration allows for a yet narrower printer as only one printhead needs to go past the platen to be serviced.

In one embodiment, a motor is located in the removable tray. The motor is used to allow the capping stations to automatically cap and uncap the printheads when instructed by the printer controller. In this embodiment, the removable tray also contains electrical contact pads to provide electricity to the motor for traversing the capping stations. For example, the capping station can move up for capping the printhead and down for uncapping the printhead.

In another embodiment, the motor is located within the body of the printer. In this embodiment, the capping stations can be moved via a mechanical linkage to the motor. In this case, the removable tray need not have electrical compact pads.

The present invention as well as a more complete understanding thereof will be made apparent from a study of the following detailed description of the invention in connection with the accompanying drawings and appended claims.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings, which form a part hereof, and in which is shown by way of illustration a specific embodiment in which the invention may be practiced. It is to be understood that other embodiments may be utilized and structural changes may be made without departing from the scope of the present invention.

Overview

Figure 1:
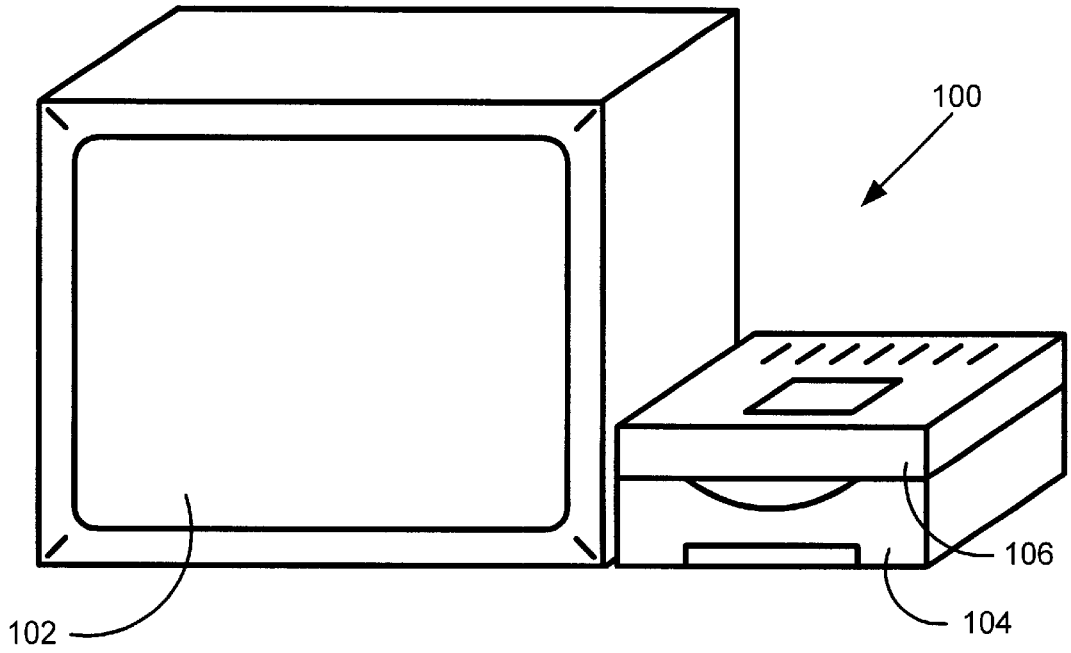
FIG. 1 depicts an overview block diagram of a home entertainment system that includes the low-profile, narrow-width printer of the present invention.

As shown in the drawings for purposes of illustration, FIG. 1 depicts an overview block diagram of a home entertainment system 100 of the present invention. Namely, the system 100 includes a television set 102, a living room printer 104 and a set-top box 106. The living room printer 104 and set-top box 106 may be placed one on top of the other on the television set 102.

The set-top box 106 is electronically connected to the television set 102 via any suitable manner, such as a coaxial cable (not shown). The set-top box 106 is also connected to the printer 104 via a printer cable or ribbon (not shown). The set-top box 106 may contain at least a processor (not shown) to process data and a non-volatile memory (also not shown) for storing software programs including a printer driver. The set-top box may also contain a connector or some sort of suitable mechanism to download or update software programs.

As previously mentioned, currently for printing purposes, problems exist when a user desires a hard copy of the information displayed on the television screen. Although conventional printers can be manually connected to some set-top boxes, most conventional printers are bulky, and thus require large amounts of space in users' home entertainment units. In addition, most conventional printers do not match the decor of entertainment equipment. The living room printer 104 in accordance with the present invention solves these problems.

Component Details and Operation

Figure 2:
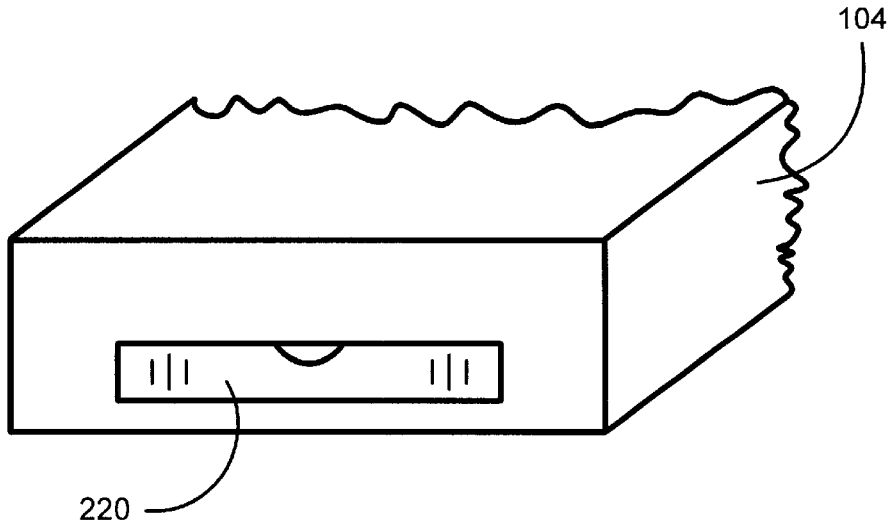
FIG. 2 illustrates a cut-away perspective view of a front portion of the printer of the present invention.

FIG. 2 illustrates a cut-away perspective view of a front portion of the printer of the present invention. Shown in the figure is an input tray 220. The input tray 220, as will be explained later, contains an integrated platen with capping stations.

Figure 3:
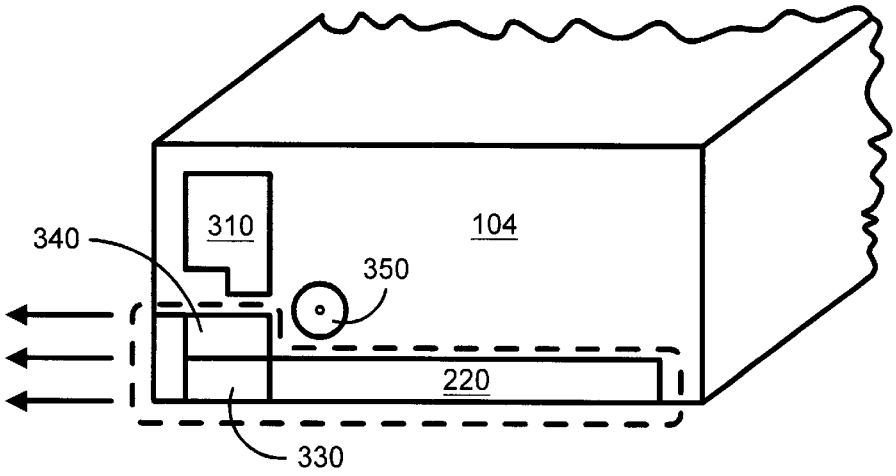
FIG. 3 illustrates a lateral cross-sectional view of the low-profile, narrow-width printer of the present invention.

FIG. 3 illustrates a lateral cross-sectional view of the living room printer 104. Shown in FIG. 3 are an inkjet printhead system 310, the removable tray 220 with integrated platen 330 and capping station 340 and a pick and feed roller 350. When the printer 104 is in use, the capping station 340 is retracted within the platen 330 to allow print media to move over the platen to be printed upon. When the printer is idle, the capping station 340 is pushed up past the surface of the platen 330 to cap the inkjet printhead system 310. Pick and feed roller 350 is used to pick up print media from the input paper tray 220 and to guide the media over the platen 330. In FIG. 3, the printer 104 is shown in its idle state. When a user has to access the printer to load paper, change ink cartridges or clear paper jams, the paper tray 220, as shown in shadow lines, is removed in the direction of the arrows.

Figure 4:
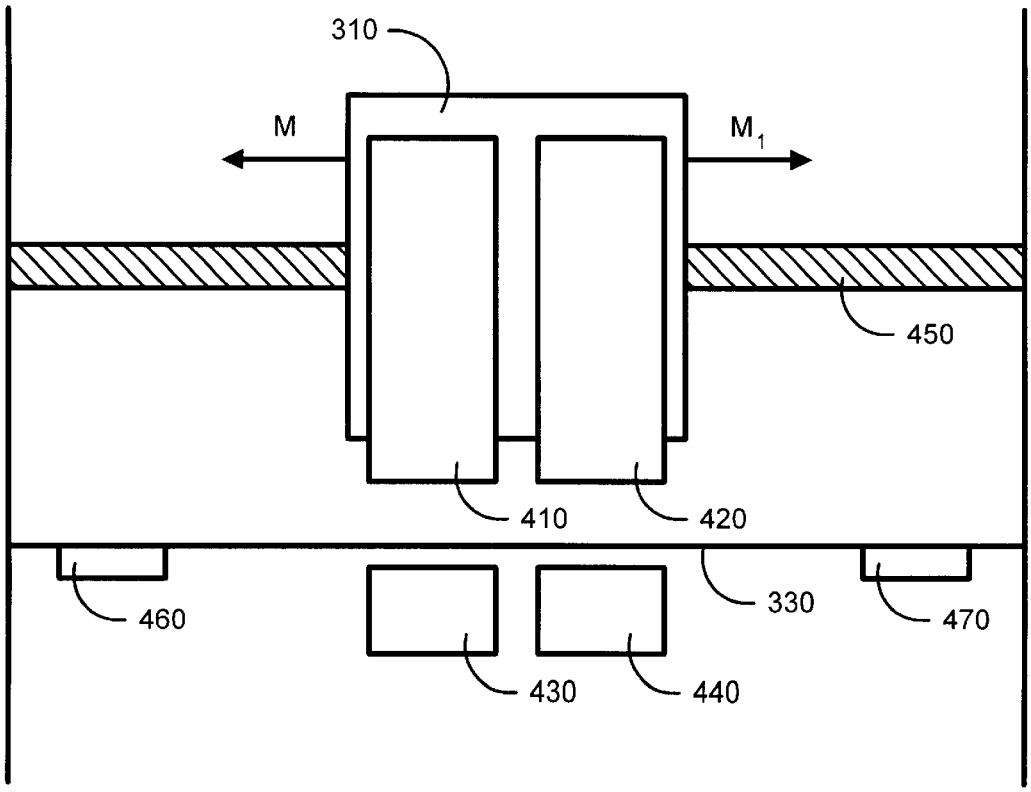
FIG. 4 illustrates a front cross-sectional view of the low-profile, narrow-width printer of the present invention.

FIG. 4 illustrates a cross-sectional view of the print engine of the living room printer 104. The inkjet printhead system 310 preferably comprises a carriage that contains multiple printheads or print cartridges 410 and 420. One of the print cartridges can be a multi-color ink cartridge and the other can be a black ink cartridge. Note that it is possible to use only a multi-color cartridge to print in either black and white or in color.

As such, the printer can have either a single cartridge, such as a black or a multi-color cartridge, or multiple cartridges, such as a multi-color ink cartridge to print in color and a black ink cartridge to print in black and white. However, for the single cartridge case, if the black ink cartridge or the multi-color ink cartridge is not already in the printer when a user wants to print in black and white or in color, respectively, the user has to intervene to switch from a black to a multi-color ink cartridge. Thus, having both a multi-color and a black ink cartridge allows the printer to print in either color or black and white without user intervention to switch from a black ink cartridge to a multi-color cartridge or vice versa before printing.

Consequently, most printer manufacturers have designed printers that can use either a multi-color ink cartridge to print in color and a black ink cartridge to print in black and white. However, if the black ink cartridge or the multi-color ink cartridge is not already in the printer when a user wants to print in black and white or in color, respectively, the user has to intervene to switch from a black to a multi-color ink cartridge or vice versa. Thus, having both a multi-color and a black ink cartridge allows the printer to print in either color or black and white without user intervention to switch from a black ink cartridge to a multi-color cartridge or vice versa before printing.

The carriage is preferably mounted on a slider rod 450 to carry print cartridges 410 and 420 in the direction indicated by arrows M and M1, this direction is perpendicular to the direction of movement of the print media. That is, this direction is from the rear of the printer to the front of the printer and vice versa. Travel of the carriage along the slider rod 450 is controlled in a conventional manner by a carriage drive motor (not shown).

Also shown in FIG. 4 are first and second capping stations 430 and 440 (similar to capping station 340) and service stations 460 and 470. Capping stations 430 and 440, shown here in their retracted state, are used to cap cartridges 410 and 420, respectively. Likewise, service stations 460 and 470 are used to service cartridges 410 and 420, respectively. Service stations 460 and 470 contain each a spittoon and a wiper. As mentioned before, the spittoon is used to dispose of ink drops and the wiper is used to wipe clean the respective printheads. Capping stations and service stations are described in general in pending U.S. patent application Ser. No. 09/115,153 entitled PRINTHEAD SERVICING TECHNIQUE, filed on Jul. 14, 1998 by Gaarder, the disclosure of which is hereby incorporated by reference.

One advantage of having service station 460 on one side and service station 470 on the other side of the platen 330 is that the printer can be of a smaller width. For example, conventionally spittoon stations and service stations for both cartridges are placed on one side of the platen. Thus, both cartridges have to clear the platen when one is being serviced. In this embodiment, however, only the cartridge in use needs to clear the platen to be serviced; thus minimizing the cartridges excursion past the platen. This, in turn, allows for a printer of a yet smaller width.

Figure 5:
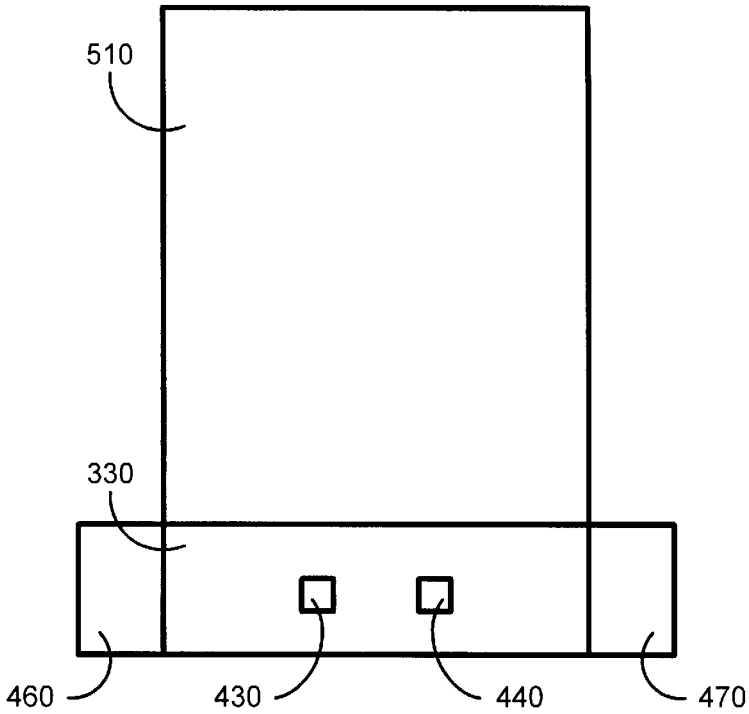
FIG. 5 is a top cross-sectional view of the removable paper tray of the low-profile, narrow-width printer of the present invention.
Figure 6:
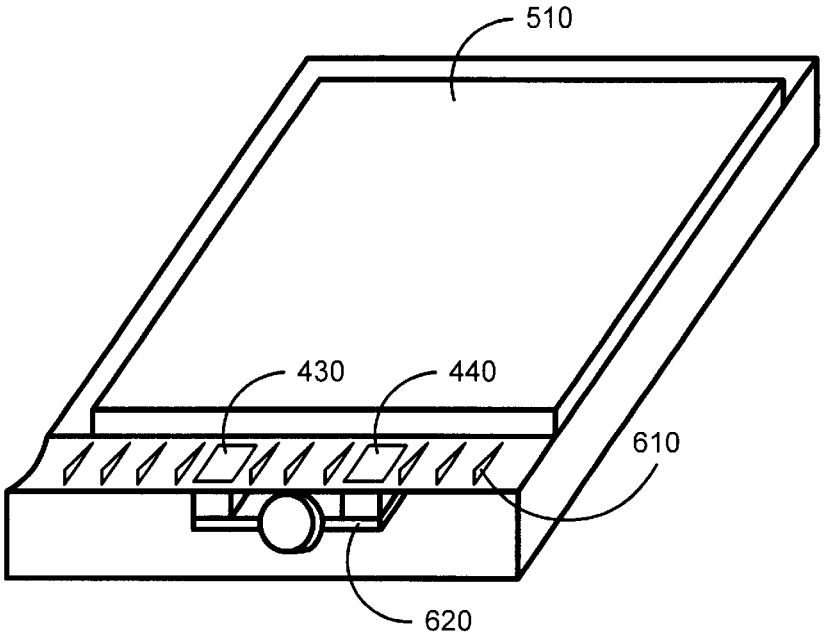
FIG. 6 illustrates the removable paper tray of the low-profile, narrow-width printer of the present invention.

FIG. 5 is a top cross-sectional view of the removable paper tray of the present invention and FIG. 6 illustrates the removable paper tray 220 of the present invention. The tray 220, as mentioned before, contains an area to hold input paper 510 and integrated platen 330 in the center of which the two capping stations 430 and 440 are located. The tray 220 also contains electrical contact pads (not shown) to provide electricity to a motor used to move the capping stations up and down.

FIG. 6 shows motor and capping assembly 620 and upstanding ribs 610. The motor of the motor and capping assembly 620 is used to raise the capping stations 430 and 440 above the surface of the platen 330 to cap cartridges 410 and 420 when the printer is not in use. The motor is also used to retract the capping stations when the printer is in use. The upstanding ribs 610 support the medium sheet 510 from below as it passes over the platen 330. The ribs 610 hold the paper at a sufficient distance above capping stations 430 and 440 to prevent residual ink contamination of the underside of the print medium 510.

Figure 7:
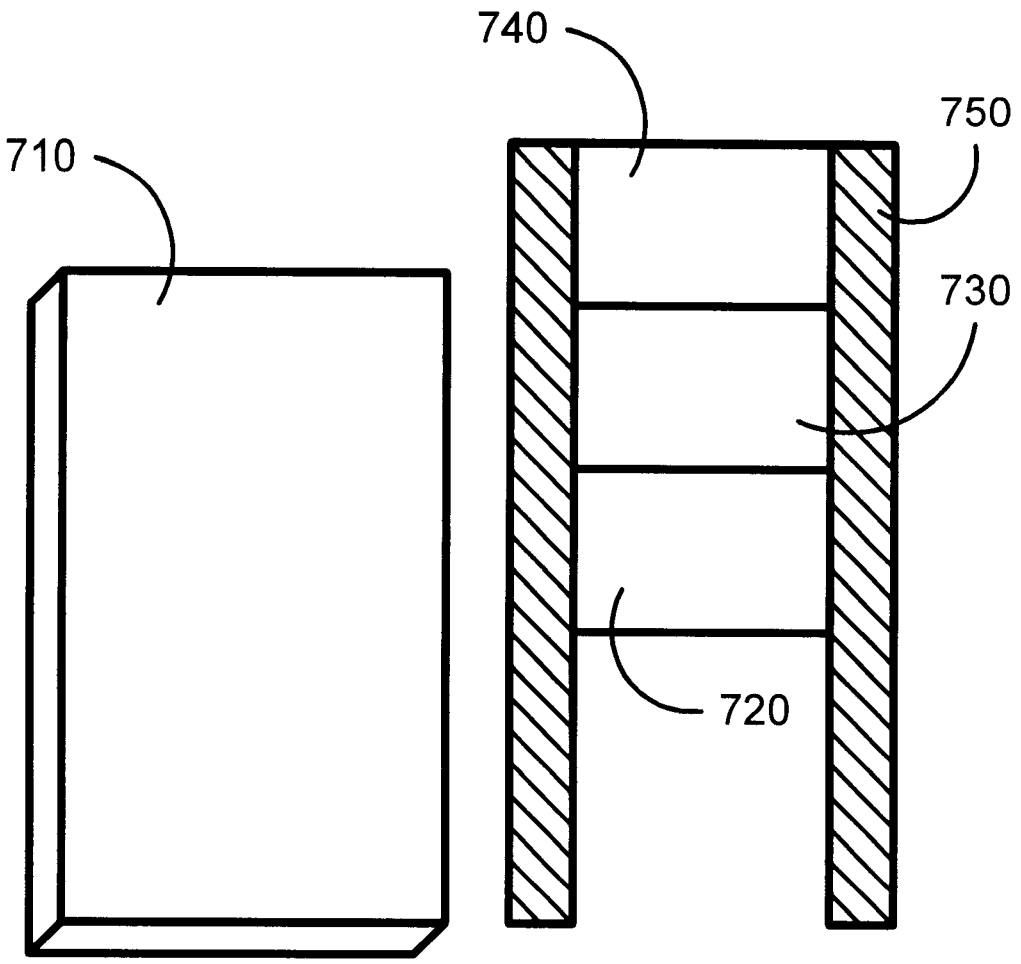
FIG. 7 is a side cross-sectional view of a motor and capping assembly used with the removable tray of the low-profile, narrow-width printer of the present invention.

Shown in cross-sectional view of FIG. 7 are a motor 710 and capping assembly 750 of the motor and capping assembly 620. The capping assembly 750 comprises a rack having a spur gear 730, a worm gear 720 and capping station 740. In operation, the motor 710 engages the spur gear 730, which engages the worm gear 720 to move the capping station 740 up or down. To protect the capping stations from damage, the motor may retract the capping stations before the tray is removed. In this case, the tray handle may contain an electrical switch that will inevitably be turned on when a user tries to remove the tray. At that time, the motor will retract the capping stations before releasing a latch (not shown) allowing the tray to be removed. Upon the tray's reinsertion into the printer, the motor will engage the spur gear 730 and worm gear 720 to push the capping stations back up to cap the printheads and re-engage the latch.

Alternatively, the tray may contain a capacitor to provide electricity to the motor to retract the capping stations after the tray is removed from the printer. Likewise in this case, the capping stations will move up to cap the printheads upon the tray's reinsertion into the printer.

In the present embodiment, the motor 710 is shown located in the tray, however, the motor need not be in the removable tray. The motor may be located in the body of the printer and the capping stations may be moved up and down through some sort of mechanical linkage to the motor. The mechanical linkage would disengage when the tray is removed and re-engaged upon reinsertion of the tray into the printer. In this case, an electrical connector may not be needed.

Also, the width of the printer can be further reduced if only one printhead is used as only one service station will be needed. In this case, color and black and white ink printhead can be interchanged to either print in color or in black and white, respectively.

The description of the present invention has been presented for purposes of illustration and description, but is not intended to be exhaustive or limited to the invention in the form disclosed. Many modifications and variations will be apparent to those of ordinary skill in the art. For example, the printer need not be an inkjet printer. Therefore, the foregoing description should not be taken as limiting the scope of the invention defined by the appended claims.

What is claimed is:

1. A printer comprising:

at least one printhead;

a platen having a print area where media are printed upon by the printhead, the platen being integrated into a removable input tray that holds the media;

at least one capping station that uses a motor located underneath the platen to move the capping station up when the at least one printhead is not in use and down when the at least one printhead is in use; and a print engine mechanism for acquiring the media from the removable input tray and for guiding the media above the platen to be printed upon by the at least one printhead.

2. The printer of claim 1 wherein the at least one capping station is located in the platen for capping the at least one printhead during periods of non-use.

3. The printer of claim 1 wherein the at least one capping station is located at the center of a longwise horizontal dimension of the print area of the platen.

4. The printer of claim 1 wherein the capping station is selectively moved up and down by the motor.

5. The printer of claim 1 wherein the removable tray provides electricity to the motor to move the at least one capping station up and down.

6. The printer of claim 5 further comprising a capacitor, the capacitor being located within the platen to provide electricity to the motor to retract the capping station when the removable tray is removed from the printer.

7. The printer of claim 5 wherein the removable tray contains a mechanical switch providing a signal to the motor to retract the capping station before the removable tray is removed.

8. The printer of claim 7 wherein the removable tray is prevented from being removed before the capping station is retracted.

9. A printer comprising:

a printhead;

a removable input tray for holding media;

a platen having a print area where the media are printed upon, the platen being integrated into the removable input tray;

at least two service stations located each at one side of the platen, each service station providing a receptacle for print drops and a wiper for wiping clean the at least one printhead; and a print engine mechanism for acquiring the media from the removable input tray and for guiding the media above the platen to be printed upon by the at least one printhead.

10. The printer of claim 9 further comprising at least two printheads for printing on media sheets, wherein one of the printheads contains black and white ink to print in black and white on the media and another printhead contains multicolor ink to print in color on the media.

11. The printer of claim 9 further comprising at least two capping stations located in the platen for capping the at least two printheads during periods of non-use.

12. The printer of claim 11 wherein the at least two capping stations are at a center to center of the at least two printheads and located at the center of a longwise horizontal dimension of the print area of the platen.

13. The printer of claim 12 further comprising a motor, the motor being located underneath the platen for moving the at least two capping stations up when the at least two printheads are not in use and down when the at least two printheads are in use.

14. The printer of claim 13 wherein the at least two capping stations are moved up and down by the motor.

15. The printer of claim 13 wherein the removable tray provides electricity to the motor to move the at least two capping stations up and down.

16. The printer of claim 15 wherein the removable tray contains a mechanical switch providing a signal to the motor to retract the at least two capping stations before the removable tray is removed.

17. The printer of claim 16 wherein the removable tray is prevented from being removed before the at least two capping stations are retracted.

18. The printer of claim 15 further comprising a capacitor, the capacitor being located within the platen to provide electricity to the motor to retract the at least two capping stations when the removable tray is removed from the printer.

* * * * *

UNITED STATES PATENT AND TRADEMARK OFFICE

CERTIFICATE OF CORRECTION

PATENT NO. : 6,328,492 B1
DATED : December 11, 2001
INVENTOR(S) : McKay et al.

It is certified that error appears in the above-identified patent and that said Letters Patent is hereby corrected as shown below:

Title page,
Item [75], Inventors, "Kilne" should read -- Kline --.

Signed and Sealed this

Twelfth Day of August, 2003

JAMES E. ROGAN
*Director of the United States Patent and Trademark Office*